US011637380B2

(12) United States Patent
Seong et al.

(10) Patent No.: US 11,637,380 B2
(45) Date of Patent: Apr. 25, 2023

(54) VERTICAL POLARIZED ANTENNA AND TERMINAL DEVICE

(71) Applicants: SK TELECOM CO., LTD., Seoul (KR); POSTECH ACADEMY-INDUSTRY FOUNDATION, Gyeongsangbuk-do (KR)

(72) Inventors: Hee Chang Seong, Seoul (KR); Joon Young Shin, Seoul (KR); Sung Yong Kang, Seoul (KR); Won Bin Hong, Seoul (KR); Jun Ho Park, Seoul (KR)

(73) Assignees: SK TELECOM CO., LTD., Seoul (KR); POSTECH ACADEMY-INDUSTRY FOUNDATION, Gyeongsangbuk-do (KR)

( * ) Notice: Subject to any disclaimer, the term of this patent is extended or adjusted under 35 U.S.C. 154(b) by 87 days.

(21) Appl. No.: 16/769,653

(22) PCT Filed: Jan. 16, 2019

(86) PCT No.: PCT/KR2019/000646
§ 371 (c)(1),
(2) Date: Jun. 4, 2020

(87) PCT Pub. No.: WO2019/143126
PCT Pub. Date: Jul. 25, 2019

(65) Prior Publication Data

US 2021/0367345 A1 Nov. 25, 2021

(30) Foreign Application Priority Data

Jan. 19, 2018 (KR) ..... 10-2018-0007336

(51) Int. Cl.
*H01Q 9/18* (2006.01)
*H01Q 13/18* (2006.01)
(Continued)

(52) U.S. Cl.
CPC ..... *H01Q 13/18* (2013.01); *H01Q 1/243* (2013.01); *H01Q 21/064* (2013.01)

(58) Field of Classification Search
CPC ..... H01Q 13/18; H01Q 21/064; H01Q 1/243; H01Q 3/26; H01Q 9/18; H01Q 1/46
See application file for complete search history.

(56) References Cited

U.S. PATENT DOCUMENTS 2,946,055 A * 7/1960 Faflick ..... H01Q 19/28 343/727
2,972,147 A * 2/1961 Wilkinson ..... H01Q 13/18 343/756
(Continued)

FOREIGN PATENT DOCUMENTS

CN 1949594 4/2007
CN 101013774 8/2007
(Continued)

OTHER PUBLICATIONS

International Search Report dated Apr. 29, 2019 issued in Application No. PCT/KR2019/000646.
(Continued)

*Primary Examiner* — Ab Salam Alkassim, Jr.
*Assistant Examiner* — Bamidele A Jegede
(74) *Attorney, Agent, or Firm* — KED & Associates LLP

(57) ABSTRACT

The present disclosure provides technology that proposes an ultra-high frequency band (mmWave band) vertical polarization antenna having a new structure applicable to a slim planar structure (e.g., a terminal).

15 Claims, 8 Drawing Sheets

(51) Int. Cl.
*H01Q 1/24* (2006.01)
*H01Q 21/06* (2006.01)

(56) References Cited

U.S. PATENT DOCUMENTS 3,022,505 A * 2/1962 Scharp ..... H01Q 13/16 343/767
4,242,685 A * 12/1980 Sanford ..... H01Q 13/106 343/700 MS
4,371,877 A * 2/1983 Doussot ..... H01Q 13/106 343/846
4,743,915 A * 5/1988 Rammos ..... H01Q 21/064 343/776
4,958,165 A * 9/1990 Axford ..... H01Q 13/18 343/770
5,194,876 A * 3/1993 Schnetzer ..... H01Q 13/18 343/746
5,568,160 A * 10/1996 Collins ..... H01Q 21/0087 343/778
5,914,693 A * 6/1999 Takei ..... H01Q 1/243 343/771
6,064,350 A * 5/2000 Uchimura ..... H01Q 21/0093 343/786
6,166,701 A * 12/2000 Park ..... H01Q 21/0037 333/21 A
6,198,437 B1 * 3/2001 Watson ..... H01Q 21/064 343/846
6,483,466 B2 * 11/2002 Liu ..... H01Q 23/00 343/702
6,859,186 B2 * 2/2005 Lizalek ..... H01Q 1/286 343/767
2002/0000943 A1 * 1/2002 Oberschmidt ..... H01Q 13/16 343/770
2003/0174095 A1 * 9/2003 Sievenpiper ..... H01Q 13/10 343/770
2005/0068239 A1 * 3/2005 Fischer ..... H01Q 21/064 343/770
2007/0080878 A1 * 4/2007 McLean ..... H01Q 13/106 343/729
2009/0153412 A1 * 6/2009 Chiang ..... H01Q 1/52 343/702
2009/0231215 A1 * 9/2009 Taura ..... H01Q 1/243 343/702
2009/0262029 A1 * 10/2009 Chiang ..... H01Q 1/2266 343/702
2010/0073241 A1 * 3/2010 Ayala Vazquez .... H01Q 1/2266 343/702
2011/0050508 A1 * 3/2011 Guterman ..... H01Q 1/2266 343/702
2011/0241943 A1 * 10/2011 Shiu ..... H01Q 13/18 228/256
2012/0098706 A1 * 4/2012 Lin ..... H01Q 21/065 343/700 MS
2012/0229343 A1 * 9/2012 Sudo ..... H01Q 1/38 343/700 MS
2012/0287019 A1 11/2012 Sudo et al.
2013/0002517 A1 * 1/2013 Pascolini ..... H01Q 1/2266 343/878
2013/0050032 A1 * 2/2013 Shiu ..... H01Q 1/2258 343/702
2013/0088396 A1 * 4/2013 Han ..... H01Q 9/04 343/700 MS
2013/0293424 A1 * 11/2013 Zhu ..... H01Q 13/10 343/702
2013/0314287 A1 * 11/2013 Xie ..... H01Q 5/378 343/770
2014/0361931 A1 * 12/2014 Irei ..... H01Q 1/38 343/702
2015/0311594 A1 * 10/2015 Zhu ..... H01Q 21/28 343/702
2015/0364823 A1 * 12/2015 Hashimoto ..... H01Q 9/0407 343/700 MS
2016/0006118 A1 * 1/2016 Maruyama ..... H01Q 13/18 343/702
2016/0043470 A1 2/2016 Ko et al.
2016/0087348 A1 * 3/2016 Ko ..... H01Q 1/521 455/73
2016/0164186 A1 * 6/2016 Ganchrow ..... H01Q 13/18 343/702
2018/0294576 A1 * 10/2018 Niakan ..... H01Q 1/2258
2018/0375183 A1 * 12/2018 Goto ..... H01P 3/06
2019/0006766 A1 * 1/2019 Yonei ..... H01Q 13/16
2019/0148823 A1 * 5/2019 Stiborek ..... H01Q 13/16 343/878

FOREIGN PATENT DOCUMENTS

CN 101013774 A * 8/2007 ..... H01Q 13/10
CN 102593584 7/2012
CN 102683835 9/2012
CN 103460507 12/2013
CN 112768884 5/2021
JP 4409257 B2 * 2/2010 ..... H01Q 1/38
JP 2012-090257 5/2012
KR 10-2007-0054980 5/2007
KR 10-2013-0037083 4/2013
KR 10-2016-0016465 2/2016
KR 10-2017-0086532 7/2017
WO WO 2016/043450 3/2016

OTHER PUBLICATIONS

Jun. 2017, pp. 1544-1546 (Park, Junho et al. A mmWave Vertically-polarized End-fire Antenna with Extremely-small Profile. The Institute of Electronics and Information Engineers Conference.).
Korean Office Action dated Dec. 24, 2018 issued in Application No. 10-2018-0007336 (English translation attached).
Korean Office Action dated Jan. 11, 2021 issued in Application No. 10-2019-0062012 (English translation attached).
Li Yue et al: "Design of Omnidirectional Dual-Polarized Antenna in Slender and Low-Profile Column", IEEE Transactions on Antennas and Propagation, IEEE Service Center, Piscataway, NJ, US, vol. 62, No. 4, Apr. 1, 2014 (Apr. 1, 2014), pp. 2323-2326, XP011544680, ISSN: 0018-926X, DOI: 10.1109/TAP.2014.2303817 [retrieved on Apr. 3, 2014].
Park Junho et al: "A mmWave Vertically-polarized End-fire Antenna with Extremely-small Profile", Korean Society of Electronic Engineering Summer Conference 2017, Jun. 30, 2017 (Jun. 30, 2017), pp. 1544-1546, XP009521298, section II figures 1, 2.
European Search Report dated Sep. 1, 2021 issued in Application No. 19741478.2.
Chinese Office Action dated Sep. 5, 2022 issued in CN Application No. 201980009027.8.
"Ultra-Wideband Slot Antenna with Controllable Notched Bandwidth," School of Electric Power, South China University of Technology, Guangzhou, 510640, Guangdong, China, vol. 38, No. 12, Dec. 2010.

* cited by examiner

VERTICAL POLARIZED ANTENNA AND TERMINAL DEVICE

BACKGROUND OF THE INVENTION

1. Field of the Invention

The present disclosure relates to a technique for implementing a vertical polarization antenna applicable to a planar structure.

This application is a U.S. National Stage Application under 35 U.S.C. § of PCT Application No. PCT/KR2019/000646, filed Jan. 16, 2019, which claims priority to Korean Application No. 10-2018-0007336 filed on Jan. 19, 2018, the disclosure of which is incorporated herein in its entirety by reference for all purposes.

2. Description of the Prior Art

A 5G communication system uses an ultra-high frequency band (mmWave band) compared to the frequency band currently used in an LTE (4G) communication system.

Due to the propagation characteristic of radio waves in the air, signal attenuation occurs between counterpart transmission and reception terminals when polarization loss occurs.

Meanwhile, in a mobile communication system, counterpart transmission and reception terminals may be considered as a base station and a terminal.

Unlike an antenna of a base station having a fixed position, position coordinates of a terminal antenna are always variable, so that polarization loss occurs thereby a serious level of signal attenuation being caused.

In particular, polarization loss caused due to rotation in the theta direction (change of position coordinates) of the terminal antenna may even cause a situation in which actual communication is lost (a wireless link loss situation) in the ultra-high frequency band (mmWave band) having strong linearity.

Accordingly, in a 5G mobile communication system using the ultra-high frequency band (mmWave band), it is important to design a terminal antenna such that polarization loss does not occur even when a terminal moves and the position coordinates of the terminal antenna changes accordingly.

Meanwhile, vertically polarized waves undergo relatively small signal attenuation compared to horizontally polarized waves for the same propagation distance. Thus, it is necessary to apply a vertical polarization antenna to a terminal in a mobile communication system.

Consequently, in a 5G mobile communication system using an ultra-high frequency band (mmWave band), it may be said that it is essential to apply a vertical polarization antenna designed to prevent polarization loss.

Terminals in mobile communication systems, such as smartphones and tablet PCs, are designed to have a planar structure having a very small height compared to a width, and will develop into a slimmer planar structure having a smaller height in the future.

Meanwhile, a vertical polarization antenna has a limitation in height rather than width due to its structural characteristics, and the existing vertical polarization antennas for ultra-high frequency band (mmWave band), which are currently used, have a disadvantage in that they are in appropriate in terms of height to be applied to a terminal having a slim planar structure.

Accordingly, the present disclosure proposes vertical polarization antenna an ultra-high frequency band (mmWave band) having a new structure applicable to a slim planar structure (e.g., a terminal).

SUMMARY OF THE INVENTION

Accordingly, an object of the present disclosure is to provide an ultra-high frequency band (mmWave band) vertical polarization antenna having a new structure applicable to a slim planar structure (e.g., a terminal).

A vertical polarization antenna according to an embodiment of the present disclosure includes: an aperture antenna including a flat conductor plate having an aperture formed therein, wherein the aperture has a shape bent along a bending line extending in a lengthwise direction thereof and the aperture antenna is configured to radiate vertically polarized waves through the aperture; and a cavity structure coupled to a rear side of the aperture antenna.

Specifically, the cavity structure may be configured to block propagation of rearward radiation through the aperture.

Specifically, the cavity structure may be configured to cause the rearward radiation through the aperture to resonate within a cavity formed by the cavity structure so as to be coupled to forward radiation through the aperture.

Specifically, the aperture may be divided into a top surface and a side surface with reference to the bending line, and the aperture antenna may include a power feeder in the center area of the top surface of the aperture.

Specifically, the power feeder may include a power feeding line extending on the flat conductor plate toward the bending line and a converter extending in the lengthwise direction of the aperture.

Specifically, the converter may be configured to store electricity applied from the power feeding line and to convert the electricity into a magnetic field.

Specifically, the aperture may be divided into a top surface and a side surface with reference to the bending line, and the top surface of the aperture may have a width larger than that of the side surface of the aperture.

Specifically, edges of the side surface of the aperture may have an angled shape, and edges of the top surface of the aperture may have a curved shape.

Specifically, the aperture may be divided into a top surface and a side surface with reference to the bending line, and the aperture antenna may have a resonance frequency that is determined depending on a width of the top surface of the aperture and a length of the aperture.

Specifically, the flat conductor plate may be divided into a top surface and a front surface with reference to the bending line, and the cavity structure may include a bottom surface facing the top surface of the flat conductor plate, a rear surface facing the front surface of the flat conductor plate, and side surfaces connected to the bottom surface and the rear surface of the cavity structure and facing each other.

Specifically, each of the bottom surface, the rear surface, and the side surfaces may have a planar shape or a curved shape.

The cavity structure may have a length and a width that make a resonance frequency within the cavity equal to a resonance frequency of the aperture antenna.

A terminal device according to an embodiment of the present disclosure may include an antenna and a transmission/reception processor configured to process a signal transmitted/received through the antenna. The antenna may include: an aperture antenna including a flat conductor plate having an aperture formed therein, wherein the aperture has a shape bent along a bending line extending in a lengthwise direction thereof and the aperture antenna is configured to radiate vertically polarized waves through the aperture; and a cavity structure coupled to a rear side of the aperture antenna.

Specifically, a plurality of antennas may be arranged along an outer edge of a circuit board on which the transmission/reception processor is disposed.

Specifically, the plurality of antennas may be positioned on the same plane as the transmission/reception processor.

Accordingly, according to embodiments of the present disclosure, by implementing a super-high frequency band (mmWave band) vertical polarization antenna having a new structure improving antenna performance while significantly minimizing height, the vertical polarization antenna can be freely applied to a slim planar structure (e.g., a terminal).

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION OF THE EXEMPLARY EMBODIMENTS

Figure 1:
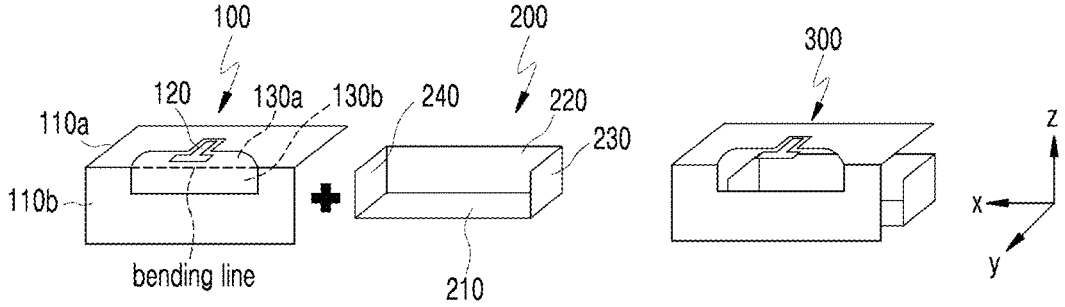
FIGS. 1 and 2 are illustrative views each illustrating a structure in which an aperture antenna and a cavity structure according to an embodiment of the present disclosure are coupled to each other.

Hereinafter, some embodiments of the present disclosure will be described in detail with reference to illustrative drawings. In addition, in adding reference numerals to the components in each of the drawings, it shall be noted that like components are denoted by like reference numerals even if the components are illustrated in different drawings. In the following description of the present disclosure, a detailed description for known functions and configurations incorporated herein will be omitted when it is determined that the detailed description may make the subject matter of the present disclosure rather unclear.

The present disclosure is to propose a vertical polarization antenna that is applicable to a slim planar structure of a terminal in a mobile communication system, such as a smartphone or a tablet PC, and more particularly, an ultra-high frequency band (mmWave band) vertical polarization antenna structure.

A 5G communication system uses an ultra-high frequency band (mmWave band) compared to the frequency band currently used in an LTE (4G) communication system.

Due to the propagation characteristic of radio waves in the air, signal attenuation occurs between counterpart transmission and reception terminals when polarization loss occurs.

Meanwhile, in a mobile communication system, counterpart transmission and reception terminals may be considered as a base station and a terminal.

Unlike an antenna of a base station having a fixed position, a terminal antenna whose position coordinates are always variable may cause a serious level of signal attenuation when polarization loss occurs due to a change in the position coordinates.

In particular, polarization loss caused due to rotation in the theta direction (position coordinate change) of the terminal antenna may even cause a situation in which actual communication is lost (a wireless link loss situation) in the ultra-high frequency band (mmWave band) having strong linearity.

Accordingly, in a 5G mobile communication system using the ultra-high frequency band (mmWave band), it is important to design a terminal antenna such that polarization loss does not occur even when a terminal moves variously and the position coordinates of the terminal antenna changes accordingly.

Meanwhile, vertically polarized waves undergo relatively small signal attenuation compared to horizontally polarized waves for the same propagation distance. Thus, it is necessary to apply a vertical polarization antenna to a terminal in a mobile communication system.

Consequently, in a 5G mobile communication system using an ultra-high frequency band (mmWave band), it may be considered to apply various polarization antennas such as a horizontal polarization antenna to a terminal, but it may be said that it is essential to apply a vertical polarization antenna designed to prevent polarization loss to a terminal.

Terminals in mobile communication systems, such as smartphones and tablet PCs, are designed to have a planar structure having a very small height compared to a width, and will develop into a slimmer planar structure having a smaller height in the future.

Meanwhile, a vertical polarization antenna has a limitation in height rather than width due to its structural characteristics.

Accordingly, the existing ultra-high frequency band (mmWave band) vertical polarization antenna having an end-fire radiation pattern suitable for a mobile communication environment has a disadvantage in terms of height to be applied to a terminal having a slim planar structure.

Accordingly, the present disclosure proposes a ultra-high frequency band (mmWave band) vertical polarization antenna having a new structure having an end-fire radiation pattern and being applicable to a slim planar structure (e.g., a terminal).

Hereinafter, a vertical polarization antenna having a new structure proposed by the present disclosure will be described in detail with reference to FIGS. 1 to 3.

First, a coupling structure of a vertical polarization antenna according to an embodiment of the present disclosure will be described with reference to FIG. 1.

As illustrated in FIG. 1, a vertical polarization antenna 300 according to an embodiment of the present disclosure includes: an aperture antenna 100, which is a flat conductor plate having an aperture formed therein, wherein the aperture has a shape bent along a bending line extending in the lengthwise direction thereof and the aperture antenna is configured to radiate vertically polarized waves through the aperture; and a cavity structure 200 coupled to the rear side of the aperture antenna 100.

That is, the vertical polarization antenna 300 of the present disclosure is implemented in a structure in which the cavity structure 200 is coupled to the rear side of the aperture antenna 100.

For convenience of description, hereinafter, in a three-dimensional space represented by x, y, and z axes, the two-dimensional space defined by the x axis and the y axis will be regarded as a ground, and the direction perpendicular to the ground (x axis, y axis) will be regarded as the z-axis direction.

The shape of the aperture antenna 100 in the vertical polarization antenna 300 of the present disclosure will be described below.

Assuming a shape obtained by vertically erecting a flat conductor plate having an aperture having a predetermined length and width without bending, vertically polarized waves will be radiated back and forth through the aperture in a planar shape.

As illustrated in FIG. 1, the vertical polarization antenna 300 of the present disclosure is designed to have a shape obtained by bending the flat conductor plate along a bending line extending in the lengthwise direction of the aperture from the shape obtained by vertically erecting the flat conductor plate as assumed above.

In the aperture antenna 100, the flat conductor plate (110*a*, 110*b*) is divided into a top surface 110*a* and a front surface 110*b* with reference to a bending line, and the bent aperture (130*a*, 130*b*) may be divided into a top surface 130*a* and a side surface 130*b* with reference to the bending line.

As noted from FIG. 1, the front surface 110*b* of the flat conductor plate and the side surface 130*b* of the aperture are still erected in the vertical direction (z axis), and the top surface 110*a* of the flat conductor plate and the top surface 130*a* of the aperture have a structure that is bent from the vertical direction (z axis) to be laid down along the ground (x axis, y axis).

Then, in the vertical polarization antenna 300 of the present disclosure, the aperture antenna 100 includes a power feeder 120 configured to feed power to the aperture in the center of the top surface 130*a* of the aperture.

The power feeder 120 will be described in more detail in the following description.

In this case, the aperture antenna 100 may radiate vertically polarized waves, through the aperture, in the front-rear direction, that is, forward (in the +y-axis direction) and rearward (in the −y-axis direction) during power feeding from the power feeder 120.

As described above, in the vertical polarization antenna 300 of the present disclosure, since the aperture antenna 100 is designed/implemented to have a shape obtained by bending the flat conductor plate along the bending line extending in the lengthwise direction thereof, it is possible to minimize the height of the antenna structure while maintaining an electric field distribution that radiates vertically polarized waves back and forth, compared to the shape in which the above-described flat conductor plate is erected in the vertical direction.

The cavity structure 200 is coupled to the rear side of the aperture antenna 100 to block the propagation of rearward radiation through the aperture in the aperture antenna 100.

That is, the cavity structure 200 is designed as a structure capable of blocking the propagation of vertically polarized waves unnecessarily radiated rearward from the aperture antenna 100 when the cavity structure 200 is coupled to the rear side of the aperture antenna 100, thereby implementing forward-oriented vertical polarization radiation in the vertical polarization antenna 300.

Furthermore, the cavity structure 200 has a structure such that rearward radiation through the aperture resonates within the cavity structure 200 and is coupled to forward radiation through the aperture.

That is, the cavity structure 200 is designed as a structure that blocks the rearward radiation of the aperture antenna 100 when the cavity structure 200 is coupled to the rear side of the aperture antenna 100, and that cause vertically polarized waves of rearward radiation to resonate within the cavity structure 200 so as to be coupled to the forward radiation of the aperture antenna 100, thereby implementing vertical polarization radiation having a stronger forward-oriented end-fire pattern in the vertical polarization antenna 300.

The cavity structure 200 may be designed in any structure as long as the cavity structure 200 is capable of blocking rear radiation of the aperture antenna 100 when the cavity structure is coupled to the rear side of the aperture antenna 100 and is capable of causing vertically polarized waves of rearward radiation to resonate within the cavity structure 200 so as to be coupled to the forward radiation of the aperture antenna 100.

An example of the shape of the cavity structure 200 will be described below with reference to FIG. 1.

The cavity structure 200 includes a bottom surface 210 facing the top surface 110*a* of the flat conductor plate when coupled to the rear side of the aperture antenna 100, a rear surface 220 facing the front surface 110*b* of the flat conductor plate, and opposite side surfaces 230 and 240 connected to the bottom surface 210 and the rear surface 220 of the cavity structure 200 to face each other.

At this time, in the embodiment of FIG. 1, the bottom surface 210, the rear surface 220, and the opposite side surfaces 230 and 240 each have a flat shape, and may be connected to each other in an angled form (e.g., at a right angle).

As described above, since the cavity structure 200 is designed as a structure that prevents rearward radiation from escaping out of the cavity structure 200 based on the bottom surface 210, the rear surface 220, and the opposite side surfaces 230 and 240, the rearward radiation of the aperture antenna 100 is capable of resonating in the cavity structure 200 so as to be coupled to the forward radiation of the aperture antenna 100.

Meanwhile, another example of the shape of a cavity structure 200' will be described below with reference to FIG. 2.

The cavity structure 200' also includes a bottom surface facing the top surface 110*a* of the flat conductor plate when coupled to the aperture antenna 100, a rear surface facing the front surface 110*b* of the flat conductor plate, and opposite side surfaces connected to the bottom surface and the rear surface of the cavity structure 200' to face each other.

Figure 2:
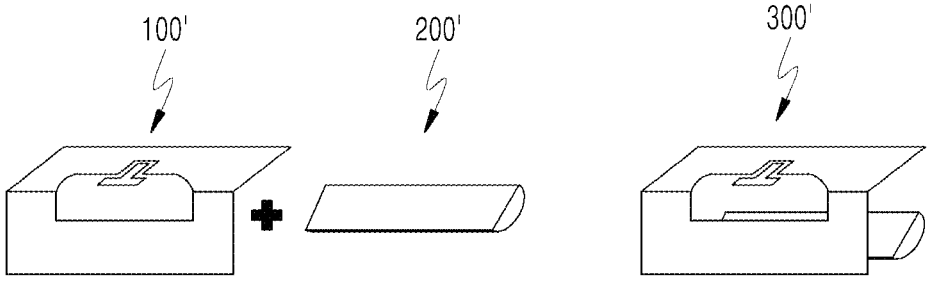

At this time, in the embodiment of FIG. 2, the bottom surface, the rear surface, and the opposite side surfaces of the cavity structure 200' each have a curved shape, and may be connected to each other in a curved form.

Of course, the bottom surface, the rear surface, and the opposite side surfaces of the cavity structure 200' may be interconnected in the state in which some of the surfaces have a flat shape and the others have a curved shape.

That is, since the cavity structure 200' is designed as a structure that prevents rearward radiation from escaping out of the cavity structure 200' based on the bottom surface, the rear surface, and the opposite side surfaces, the rearward radiation of the aperture antenna 100 is capable of resonating in the cavity structure 200' so as to be coupled to the forward radiation of the aperture antenna 100.

As described above, in the vertical polarization antenna 300 of the present disclosure, the cavity structure 200 or 200' is designed/implemented in a structure that allows the rearward radiation of the aperture antenna 100 to resonate and to be coupled to forward radiation, thereby enabling stronger forward-oriented end-fire pattern vertical polarization radiation in the vertical polarization antenna 300 or 300'.

Hereinafter, a vertical polarization antenna according to an embodiment of the present disclosure will be described from various viewpoints with reference to FIGS. 3 and 4.

However, for convenience of description, the shape of the cavity structure 200 illustrated in FIG. 1 will be described.

Figure 3:
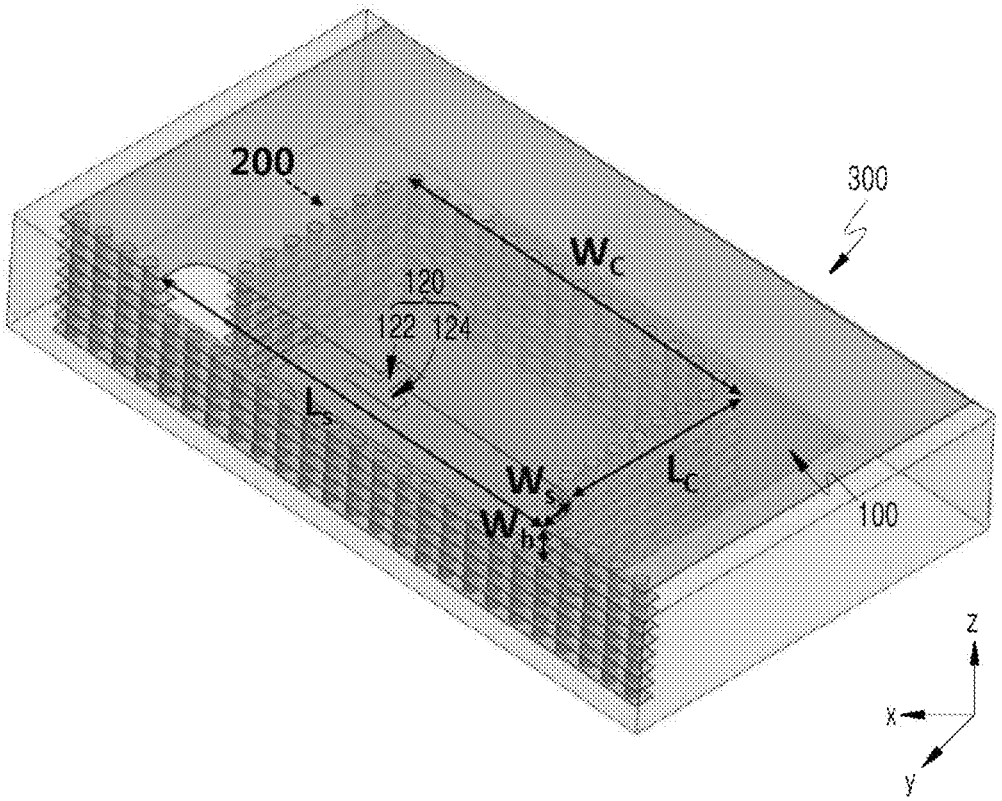
FIG. 3 is a perspective view illustrating a structure of a vertical polarization antenna according to an embodiment of the present disclosure.
Figure 4:
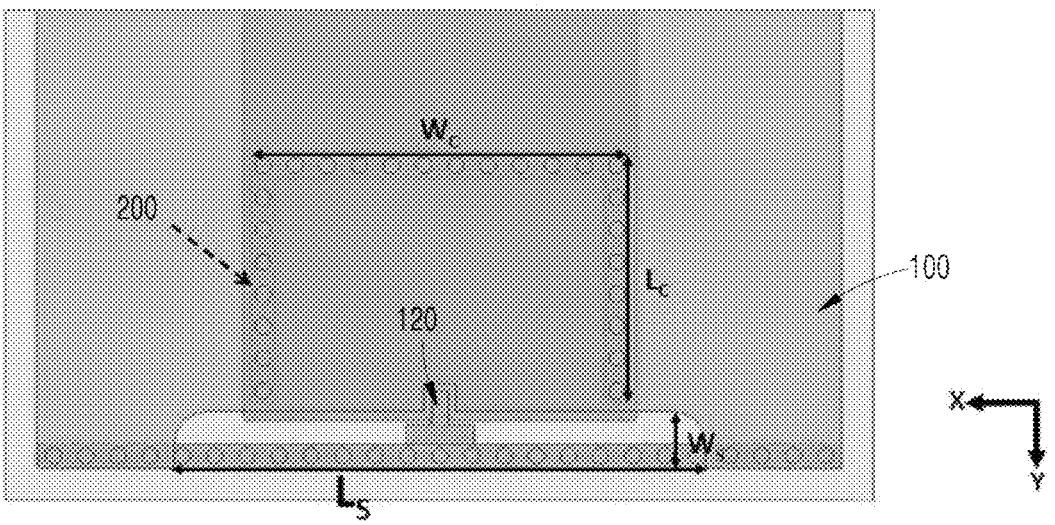
FIG. 4 is a plan view illustrating the structure of the vertical polarization antenna according to an embodiment of the present disclosure.

FIG. 3 is a perspective view of the vertical polarization antenna 300 of the present disclosure as viewed isometrically from a side, and FIG. 4 is a plan view of the vertical polarization antenna 300 of the present disclosure viewed from above.

The length Ls of the apertures 130*a* and 130*b* in the aperture antenna 100 means the length of the aperture in a planar form from the viewpoint of the flat conductor flat plate (110*a*, 110*b*).

In addition, when the width Wh of the side surface 130*b* and the width Ws of the top surface 130*a* are summed in the aperture (130*a*, 130*b*), it means the width of the aperture in a planar form from the viewpoint of the conductor flat plate (110*a*, 110*b*).

As noted from FIGS. 2 and 3, the width Ws of the top surface 103*a* is designed to be wider than the width Wh of the side surface 130*b* in the aperture (130*a*, 130*b*).

In addition, opposite edges of the side surface 130*b* in the aperture (130*a*, 130*b*) may have an angled shape, and according to an example, the opposite edges of the side surface 130*b* may have a right-angle shape.

In addition, opposite edges of the top surface 103*a* in the aperture (130*a*, 130*b*) may be curved.

As illustrated in FIGS. 3 and 4, a power feeder 120 configured to feed power to the aperture (130*a*, 130*b*) is provided in the center of the top surface 130*a* of the aperture in the aperture antenna 100.

The power feeder 120 may be in a form in which a ground signal ground (GSG) tablet PC is set on the top surface 110*a* of the flat conductor plate to be capable of being easily surface-mounted with a communication chip (not illustrated).

The power feeder 120 includes a power feeding line 122 formed to extend in the direction of the bending line on the top surface 110*a* of the flat conductor plate, and a converter 124 formed to extend in the direction of the length Ls of the aperture (130*a*, 130*b*) and configured to store electricity applied from the power feeding line 122 and to convert the electricity into a magnetic field.

The power feeding line 122 of the power feeder 120 may provide an inductive power feeding function, and the converter 120 of the power feeder 124 may provide a capacitive power feeding function.

Thus, in the power feeder 120, when electricity (current) is applied to the converter 124 from a communication chip (not illustrated) connected to the other end of the power feeding line 122, the electricity (current) will be stored in the converter 124 extending in the direction of the length Ls of the aperture (130*a*, 130*b*).

In the power feeder 120, the magnetic field generated due to the electricity (current) stored in the converter 124 is formed in the downward vertical direction from the side surface 130*b* of the aperture, that is, in the −z-axis direction while being radiated from the converter 124 formed to extend in the direction of the length Ls of the aperture (130*a*, 130*b*).

As described above, the width Ws of the top surface 130*a* is wider than the width Wh of the side surface 130*b* in the aperture (130*a*, 130*b*), the opposite edges of the top surface 130*a* have a curved shape, and the opposite edges of the side surface 130*b* have an angled shape (e.g., a right angle). Thus, among magnetic fields radiated from the converter 124, the propagation distances of the magnetic fields propagating/reflected on the opposite sides along the top surface 130*a* of the aperture to propagate in the −z-axis direction on the top surface 130*a* are shortened, and all the magnetic fields propagating in the −z-axis direction are made to propagate by the same distance on the side surface 130*b*.

That is, by designing the width Ws of the top surface 130*a* to be wider than the width Wh of the side surface 130*b* in the aperture (130*a*, 130*b*), and designing the opposite edges of the top surface 130*a* in a curved shape and the opposite edges of the side surface 130*b* in an angled shape (e.g., a right angle), it is possible to minimize/optimize an internal resistance (reflection) component that may occur during the magnetic field formation process in which the magnetic field is formed by the power feeder 120.

Then, in the vertical polarization antenna 300 of the present disclosure, the aperture antenna 100 may radiate vertically polarized waves forward and rearward, i.e., in the +y-axis direction and in the −y-axis direction, which are generated by magnetic fields formed in the −z-axis direction from the aperture, and in particular, from the side surface 130*b* of the aperture when power is fed from the power feeder 120.

At this time, the resonance frequency of the vertically polarized waves radiated from the aperture antenna 100 is determined depending on the width Wh of the top surface 130*a* of the aperture and the length Ls of the aperture.

Meanwhile, the cavity structure 200 is capable of adjusting the position of a resonance point (resonance frequency) by adjusting the width We and length Lc of the cavity structure 200.

Accordingly, the cavity structure 200 may be designed to have a structure of the length Lc and width We that makes the resonance frequency in the cavity structure 200 identical to the resonance frequency in the aperture antenna 100 such that the rearward radiation of the aperture antenna portion 100 can be coupled to the resonance and the forward radiation.

Then, in the vertical polarization antenna 300 of the present disclosure, the cavity structure 200 enables vertical polarization radiation of a stronger front-oriented end-fire pattern by allowing the rearward radiation of the aperture antenna 100 to be coupled to the resonance and the forward radiation at the same resonance frequency as the aperture antenna 100.

As described above, the vertical polarization antenna 300 of the present disclosure is implemented as a structure in which the aperture antenna 100, which is designed to have a shape that minimizes the height of the antenna structure, and the cavity structure 200, which is designed to have a structure that enables vertical polarization radiation of a strong forward-oriented end-fire pattern in the aperture antenna 100, are coupled to each other.

Figure 5:
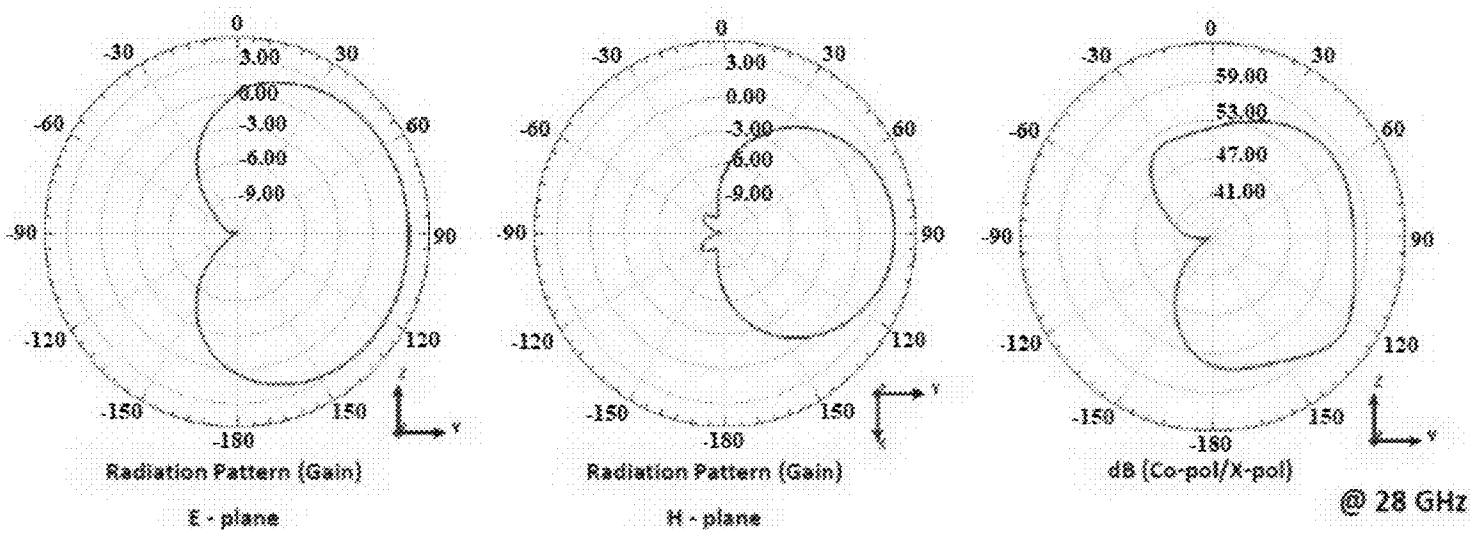
FIG. 5 is a view illustrating radiation patterns implemented in the vertical polarization antenna according to an embodiment of the present disclosure.

FIG. 5 is an illustrative view illustrating radiation patterns actually implemented in a vertical polarization antenna according to an embodiment of the present disclosure.

Referring to an E-plane radiation pattern obtained by viewing the vertical polarization antenna 300 of the present disclosure from a lateral side, it can be seen that radio waves (polarized waves) radiated from the vertical polarization antenna 300 exhibit vertical polarization characteristics in the end-fire direction (boresight at theta −90°).

That is, the vertical polarization antenna 300 of the present disclosure has a vertical polarization characteristic of an end-fire pattern.

Referring to an H-plane radiation pattern obtained by viewing the vertical polarization antenna 300 of the present disclosure from a top side, it can be seen that, in radio waves (polarized waves) radiated from the vertical polarization antenna 300, there is a difference of about 12 dB or more in magnitude between the forward radiation and the rearward radiation.

That is, the vertical polarization antenna 300 of the present disclosure has a stronger forward-oriented high front-to-back ratio characteristic.

In addition, referring to a co-polarization (Co-pol) radiation pattern and a cross polarization (X-pol) pattern in the vertical polarization antenna 300 of the present disclosure, a difference of about 50 dB or more in the magnitude of magnetic field can be observed between the co-polarization and the cross polarization in the vertical polarization antenna 300.

That is, the vertical polarization antenna 300 of the present disclosure has a low cross polarization characteristic.

As noted from the above, the present disclosure implements an ultra-high frequency band (mmWave band) vertical polarization antenna having a new structure improved in antenna performance, i.e., a front-to-back ratio characteristic and a low cross polarization characteristic while dramatically minimizing the height of the antenna structure.

Figure 6:
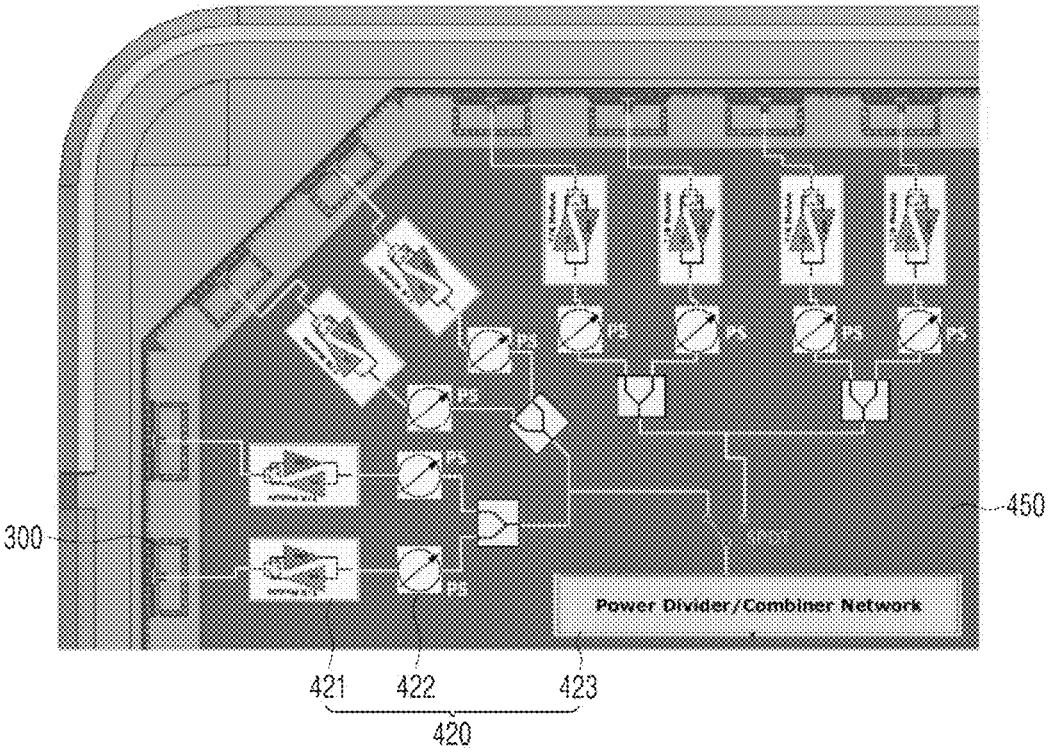
FIGS. 6 and 7 are illustrative views illustrating the usage of a vertical polarization antenna of the present disclosure by being applied to a slim planar structure (e.g., a terminal)
Figure 7:
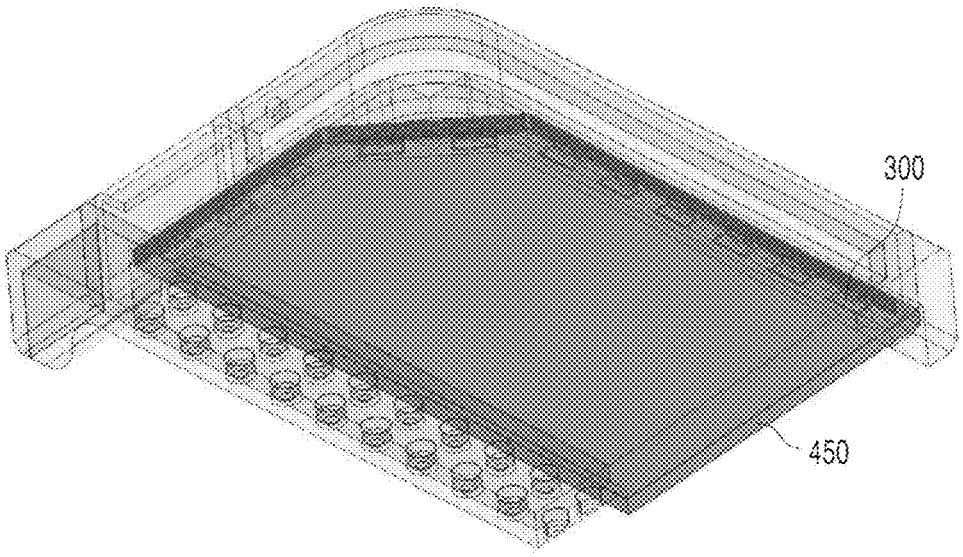

FIGS. 6 and 7 are illustrative views illustrating the usage of a vertical polarization antenna of the present disclosure by being applied to a slim planar structure (e.g., a terminal).

Since the vertical polarization antenna 300 proposed by the present disclosure has a flat shape structurally having a very small height compared to the width thereof, the vertical polarization antenna 300 has a structural advantage suitable for application to a slim flat structure, such as a terminal in a mobile communication system, such as a smartphone or a tablet PC.

In addition, the vertical polarization antenna 300 proposed by the present disclosure can be used in a multi-input multi-output (MIMO) beamforming system of an ultra-high frequency band (mmWave band).

As noted from FIGS. 6 and 7, by arranging/placing a plurality of vertical polarization antennas 300 of the present disclosure at the edges of a circuit board 450 (e.g., a PCB, an FPCB, or an LTCC) of a slim planar structure (e.g., a terminal), it is possible to minimize the placement space.

In particular, as noted from FIG. 6, thanks to the above structural advantages, the vertical polarization antenna 300 of the present disclosure can be placed on a circuit board 450, on which an RF component required in a MIMO beamforming system is placed, to be coplanar with the RF component.

As described above, when it is possible to place (position) the vertical polarization antenna 300 of the present disclosure on the same plane as the RF component, it is possible to expect an effect of having a margin in selection of resolution of a phase shifter.

In addition, thanks to the above structural advantages, the vertical polarization antenna 300 proposed by the present disclosure can be disposed, on the same plane, together with broadside radiation elements of a patch antenna or the like, in which case it is possible to expect an effect of facilitating expansion of a beam coverage.

Furthermore, thanks to the above structural advantages, the vertical polarization antenna 300 proposed by the present disclosure can be disposed together with a horizontal polarization antenna on the same plane, in which case it is possible to expect an effect of being applicable to a dual polarization antenna system or the like.

A transceiver 421, a phase shifter 422, a switch, and a power divider/combiner 423 may be implemented in the form of a chip or package.

Meanwhile, although omitted from FIG. 6 for the sake of simplicity, a transmission/reception processor (RFIC) 420 implemented in the form of a chip or a package in the state of including the transceiver 421, the phase shifter 422, the switch, and the power divider/combiner 423 may further include a modulator, a demodulator, a synthesizer, a local oscillator (LO), a digital-to-analog converter (DAC), an analog-to-digital converter (ADC), and the like.

As noted from the above, in the present disclosure, by implementing an ultra-high frequency band (mmWave band) antenna 300 having a new structure improved in antenna performance, i.e., a front-to-back ratio characteristic and a low cross polarization characteristic, it is possible to obtain an effect of being freely applicable to a slim planar structure (e.g., a terminal).

Figure 8:
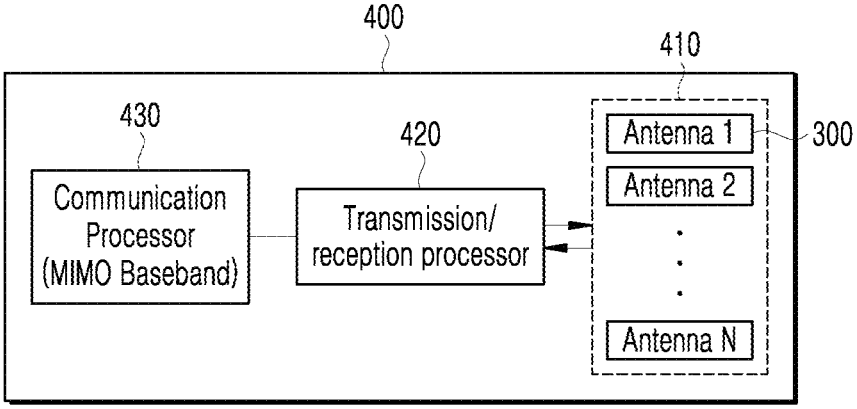
FIG. 8 is a block diagram illustrating the configuration of a terminal device according to an embodiment of the present disclosure.

Hereinafter, the configuration of a terminal device according to an embodiment of the present disclosure will be described with reference to FIG. 8.

The terminal device 400 according to an embodiment of the present disclosure includes an antenna unit 410 including a plurality of antennas, and a transmission/reception processor 420 configured to process signals transmitted/received through the antenna unit 410.

In addition, the terminal device 400 according to an embodiment of the present disclosure may further include a communication processor 430.

The communication processor 430 transmits, to the transmission/reception processor 420, a signal to be transmitted through the antenna unit 410, and receives a signal received and processed by the transmission/reception processor 420, through the antenna unit 410.

The communication processor 430 may be a MIMO baseband.

In addition, the communication processor 430 may control the phase and amplitude of the phase shifter 422 and/or a variable gain amplifier connected to each antenna channel formed in the antenna unit 410 so as to adjust the beam shape (direction/shape) of an antenna beam for signal transmission and reception.

The beam shape adjustment method described above is an analog beam forming method.

In addition to the above-described analog beam forming method, the terminal device of the present disclosure may also adopt a hybrid beam forming method, in which a digital beam forming method, an analog beam forming method, and a digital beam forming method performed by the communication processor 430 stage are combined.

The transmission/reception processor 420 processes a signal received from the communication processor 430 so as to transmit the processed signal through an antenna beam formed in a specific direction by the antenna unit 410, and processes a signal received from the antenna unit 410 through an antenna beam formed in a specific direction so as to transmit the processed signal to the communication processor 430.

The transmission/reception processor 420 is a functional unit (e.g., an RFIC) including an RF component required in a MIMO beamforming system.

Referring to FIG. 6, the transmission/reception processor 420 may include a transceiver 421, a phase shifter 422, a switch, and a power divider/combiner 423, and may further include a modulator, a demodulator, a synthesizer, a local oscillator (LO), a digital-to-analog converter (DAC), an analog to digital converter (ADC), and the like.

Accordingly, if the terminal device 400 adopts a direct conversion method, the terminal device 400 may be provided with the transmission/reception processor 420 in the form of a single RFIC.

In this case, during uplink, the transmission/reception processor 420 may process a baseband signal received from the communication processor 430 as a signal in a millimeter wave band (about 20 to 60 GHz), and may then transmit the signal through an antenna beam formed in a specific direction in the antenna unit 410.

Meanwhile, during downlink, the transmission/reception processor 420 may process a signal received through the antenna beam formed in the specific direction in the antenna unit 410, and may then transmit the signal to the communication processor 430.

In contrast, if the terminal device 400 adopts a heterodyne method using an IF frequency (about 8 to 10 GHz), the terminal device 400 may be provided with two RFIC types of transmission/reception processors 420.

In this case, the transmission/reception processor 420 is divided into two RFICs (e.g., a first RFIC and a second RFIC), and during uplink, when the first RFIC of the transmission/reception processor 420 converts a baseband signal received from the communication processor 430 into a signal having an IF frequency (about 8 to 10 GHz) and transmits the signal, the second RFIC of the transmission/reception processor 420, which receives the signal, may convert the signal into a signal in a mmWave band (about 20 to 60 GHz) and may then transmit the signal through an antenna beam formed in a specific direction in the antenna unit 410.

Meanwhile, during downlink, when the second RFIC of the transmission/reception processor 420 converts the signal received through the antenna beam formed in the specific direction in the antenna unit 410 into a signal having an IF frequency (about 8 to 10 GHz), the first RFIC of the transmission/reception processor 420, which receives the signal, may process the signal and may then transmit the signal the communication processor 430.

Each of multiple antennas constituting the antenna unit 410 (e.g., antenna 1, antenna 2, . . . , and antenna N) includes the above-described vertical polarization antenna of the present disclosure.

That is, as described above, the multiple antennas constituting the antenna unit 410 may be arranged in a form arranged along the edges of a circuit board (e.g., 450 in FIG. 6) provided in the terminal device 400.

In FIG. 6, for convenience of description, only a portion (e.g., the upper left portion) of the circuit board 450 is illustrated, but the multiple antennas constituting the antenna unit 410 may be arranged/placed along each of upper, lower, left, and right edges of the circuit board 450 provide in the terminal device 400.

As described above, the terminal device 400 according to an embodiment of the present disclosure, in particular, the terminal device 400 employing the MIMO beamforming technology in the ultra-high frequency band (mmWave band) is capable of minimizing the space for the antenna unit 410 by arranging/placing multiple vertical polarization antennas 300 in the ultra-high frequency band (mmWave band) having a new structure (structural advantage) improved in antenna performance, that is, a front-to-back ratio characteristic and a low cross polarization characteristic while dramatically minimizing the height of the antenna structure.

In particular, thanks to the above-described structural advantages of the vertical polarization antenna 300, the antenna unit 410 of the terminal device 400 according to an embodiment of the present disclosure can be placed on the circuit board 450, on which an RF component, that is, the transmission/reception processor 420, is disposed. Thus, it is possible to expect an effect of having a margin on selection of resolution of a phase shifter.

In addition, thanks to the above-described structural advantages of the vertical polarization antenna 300, the antenna unit 410 of the terminal device 400 according to an embodiment of the present disclosure and broadside radiation elements of a patch antenna or the like can be arranged on the same plane. Thus, it is possible to expect an effect of facilitating expansion of a beam coverage.

Furthermore, thanks to the above-described structural advantages of the vertical polarization antenna 300, the terminal device 400 according to an embodiment of the present disclosure may place the antenna unit 410 and a horizontal polarization antenna together on the same plane, in which case it is also possible to expect an effect of adopting a dual polarization antenna system.

Furthermore, in the terminal device 400 according to an embodiment of the present disclosure, by arranging vertical polarization antennas 300 having a structural advantage of improving the antenna performance while dramatically minimizing the height thereof along each of the upper, lower, left, and right edges of the circuit board 450, it is possible to arrange/place a larger number of vertical polarization antennas 300 compared to the conventional ones.

Therefore, in the terminal device 400 according to an embodiment of the present disclosure, with respect to a large number of vertical polarization antennas 300 provided thereto, based on a channel state of each antenna channel and the remaining battery power of the terminal device, it is possible to diversify/implement an algorithm for optimally selecting at least one vertical polarization antenna 300 to be used for signal transmission/reception.

In addition, in the terminal device 400 according to an embodiment of the present disclosure, among a large number of vertical polarization antennas 300 provided thereto, based on a channel state of each antenna channel and the remaining battery power of the terminal device 400, it is possible to diversify/implement an algorithm for optimally controlling the operation of remaining vertical polarization antennas 300 that are not selected for use in transmission/reception.

For example, in the terminal device 400, when the remaining battery power is less than a threshold, power consumption can be reduced by turning off the remaining vertical polarization antennas 300 that are not selected for use in signal transmission/reception.

In addition, in the terminal device 400, when the remaining battery power is not below a threshold, it is possible to further select some of the remaining vertical polarization antennas 300 depending on the channel state of the vertical polarization antennas 300 being used for signal transmission/reception so as to use the selected ones for spatial diversity technology, or to select at least one vertical polarization antenna 300 to be used for spatial multiplexing technology among the remaining vertical polarization antennas 300 so as to simultaneously operate different communication channels.

The subject of the selection and operation control algorithm described above may be a communication processor 430, that is, a MIMO baseband, or a separate functional unit (not illustrated).

In the foregoing, the present disclosure has been described in detail with reference to embodiments, but the present disclosure is not limited to the above-described embodiments. The technical spirit of the present disclosure will cover various modifications and changes that can be made by a person ordinarily skilled in the art to which the present disclosure belongs without departing from the gist of the present disclosure claimed in the following claims.

What is claimed is:

1. A vertical polarization antenna comprising:

an aperture antenna that includes a top flat conductor surface and a front flat conductor surface formed by a flat conductor plate bent along a bending line extending in a lengthwise direction of the aperture antenna, and the aperture antenna further includes a single aperture having a top surface at the top flat conductor surface of the aperture antenna and the single aperture having a side surface at the front flat conductor surface of the aperture antenna, the top surface of the single aperture directly coupled to the side surface of the single aperture, the aperture antenna being configured to radiate vertical polarized wave through the single aperture; and a cavity structure coupled to a rear side of the aperture antenna.

2. The vertical polarization antenna of claim 1, wherein the cavity structure is configured to block propagation of rearward radiation through the single aperture.

3. The vertical polarization antenna of claim 2, wherein the cavity structure is configured to cause the rearward radiation through the single aperture to resonate within a cavity formed by the cavity structure so as to be coupled to forward radiation through the single aperture.

4. The vertical polarization antenna of claim 3, wherein the cavity structure has a length and a width that make a resonance frequency within the cavity equal to a resonance frequency of the aperture antenna.

5. The vertical polarization antenna of claim 1, wherein the aperture antenna includes a power feeder in a center area of the top surface of the single aperture.

6. The vertical polarization antenna of claim 5, wherein the power feeder includes a power feeding line extending on the top flat conductor surface toward the bending line and a converter extending in the lengthwise direction of the aperture antenna.

7. The vertical polarization antenna of claim 6, wherein the converter is configured to store electricity applied from the power feeding line and to convert the electricity into a magnetic field.

8. The vertical polarization antenna of claim 1, wherein a width of the top surface of the single aperture is larger than a width of the side surface of the single aperture.

9. The vertical polarization antenna of claim 8, wherein edges of the side surface of the single aperture have an angled shape, and edges of the top surface of the single aperture have a curved shape.

10. The vertical polarization antenna of claim 1, wherein the aperture antenna has a resonance frequency that is determined depending on a width of the top surface of the single aperture and a length of the single aperture.

11. The vertical polarization antenna of claim 1, wherein the cavity structure includes a bottom surface facing the top flat conductor surface, a rear surface facing the front flat conductor surface, and side surfaces connected to the bottom surface and the rear surface of the cavity structure and facing each other.

12. The vertical polarization antenna of claim 11, wherein each of the bottom surface, the rear surface, and the side surfaces has a planar shape or a curved shape.

13. A terminal device comprising:

an antenna; and a transmission/reception processor configured to process a signal transmitted/received through the antenna;

wherein the antenna includes:

an aperture antenna having a single aperture, and configured to radiate vertically polarized wave through the single aperture, the aperture antenna including a top flat conductor surface and a front flat conductor surface bent from the top flat conductor surface at a bending line extending in a lengthwise direction of the aperture antenna, and the single aperture having a top surface at the top flat conductor surface of the aperture antenna and a side surface at the front flat conductor surface of the aperture antenna, the top surface of the single aperture directly coupled to the side surface of the single aperture; and a cavity structure coupled to a rear side of the aperture antenna.

14. The terminal device of claim 13, wherein a plurality of antennas are arranged along an outer edge of a circuit board on which the transmission/reception processor is disposed.

15. The terminal device of claim 14, wherein the plurality of antennas are positioned on a same plane as the transmission/reception processor.

* * * * *